United States Patent [19]

Watanabe

[11] 4,194,318

[45] Mar. 25, 1980

[54] TOY AMBULANCE UNIT

[75] Inventor: Saburo Watanabe, Tokyo, Japan

[73] Assignee: Tomy Kogyo Co., Inc., Tokyo, Japan

[21] Appl. No.: 970,867

[22] Filed: Dec. 18, 1978

[30] Foreign Application Priority Data

Dec. 17, 1977 [JP] Japan ..... 52-170804[U]

[51] Int. Cl.[2] ..... A63H 11/10

[52] U.S. Cl. ..... 46/202; 46/112; 46/1 R

[58] Field of Search ..... 46/202, 11, 201, 112, 46/111, 1 R, 101, 116

[56] References Cited

U.S. PATENT DOCUMENTS

| | | | |
|---|---|---|---|
| 2,959,891 | 11/1960 | Barnett et al. | 46/116 X |
| 4,030,235 | 6/1977 | Terzian et al. | 46/11 |
| 4,032,295 | 6/1977 | Meyer et al. | 46/202 |

FOREIGN PATENT DOCUMENTS

| | | | |
|---|---|---|---|
| 2263226 | 6/1974 | Fed. Rep. of Germany | 46/202 |
| 836760 | 6/1960 | United Kingdom | 46/1 R |

*Primary Examiner*—Louis G. Mancene
*Assistant Examiner*—Mickey Yu
*Attorney, Agent, or Firm*—Staas & Halsey

[57] ABSTRACT

A toy ambulance unit provided with a toy ambulance vehicle having a button for sounding a siren and a side door giving access to the patient portion of the vehicle, which is provided with a variety of toy medical instruments, including a toy x-ray machine which can display either of two x-ray representations and which is coupled to a rotatable drum in a toy medical oscilloscope. The toy ambulance vehicle is also supplied with a toy blood transfusion apparatus, a toy oxygen apparatus, a toy thermometer, a toy foot cast, and a toy hypodermic, all of which can be used with a toy patient doll having a mouth opening and an arm opening. The toy thermometer and the toy hypodermic have movable components for increasing the child's pleasure.

11 Claims, 9 Drawing Figures

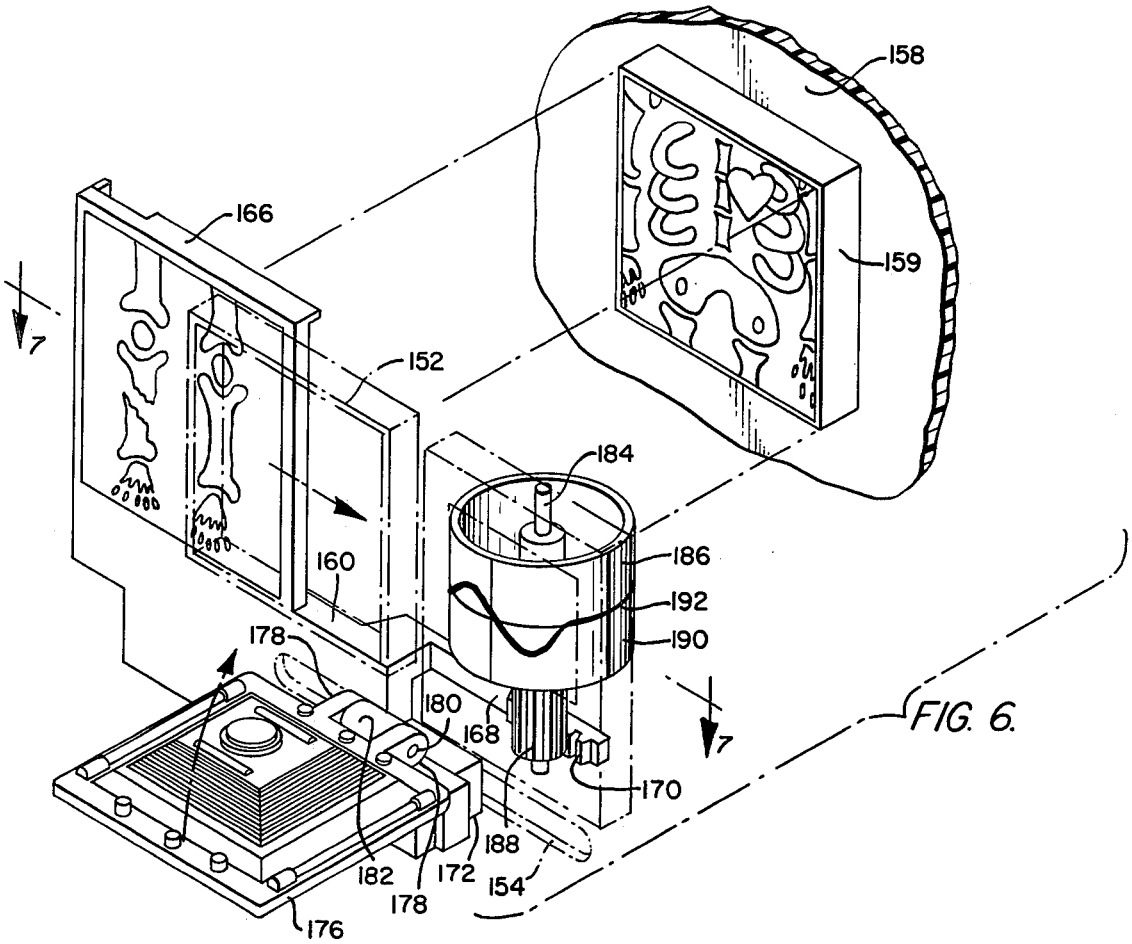
FIG. 6.
FIG. 7.
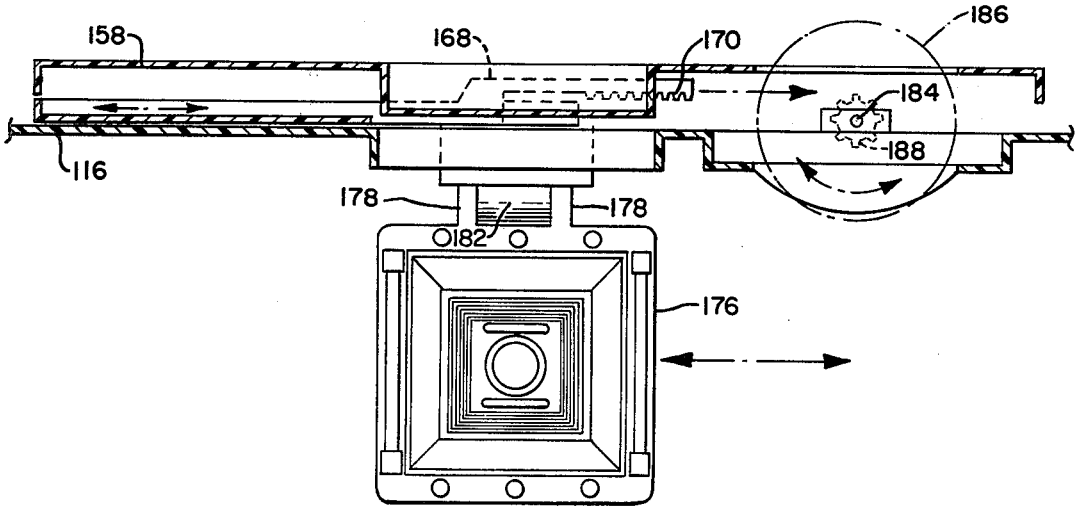

TOY AMBULANCE UNIT

BACKGROUND AND SUMMARY OF THE INVENTION

The present invention relates to a toy ambulance unit, and in particular to a toy ambulance unit having a patient portion and a variety of toy medical implements available therein. A toy x-ray unit is provided as part of a medical panel which also includes a toy medical oscilloscope having a rotating drum on which a waivering line is provided to simulate the operation of a real oscilloscope. The toy x-ray unit can display either of two representations of x-rays, and the oscilloscope drum is spun each time the x-ray representation is changed. A side door provides access to the patient portion of the toy ambulance vehicle, and toy medical implements are mounted on the side door to increase the variety of medical procedures which the child can accomplish. If a doll having an arm opening and a mouth opening is attached to a movable stretcher positioned within the patient portion of the vehicle, such implements as a toy blood transfusion apparatus which is mounted to the medical panel and which has a needle adopted for insertion in the arm opening, a toy oxygen apparatus having a toy mask with a plug adopted to fit into the mouth opening, a toy hypodermic having a movable plunger and a toy needle adopted to fit into the arm opening, and a toy thermometer having a movable plunger for use with the mouth opening can be employed. The toy hypodermic and toy thermometer are mounted to the inside of the side door, along with a toy foot cast which can be wrapped around the foot of the doll. A siren which is provided within the toy ambulance vehicle can be periodically sounded by depressing a siren button disguised as an emergency light.

BRIEF DESCRIPTION OF THE DRAWINGS

FIG. 6 is an exploded perspective view illustrating generally the construction of the toy x-ray unit and the toy medical oscilloscope;

FIG. 7 is a view taken along line 7—7 of FIG. 6;

DESCRIPTION OF THE PREFERRED EMBODIMENTS

Figure 1:
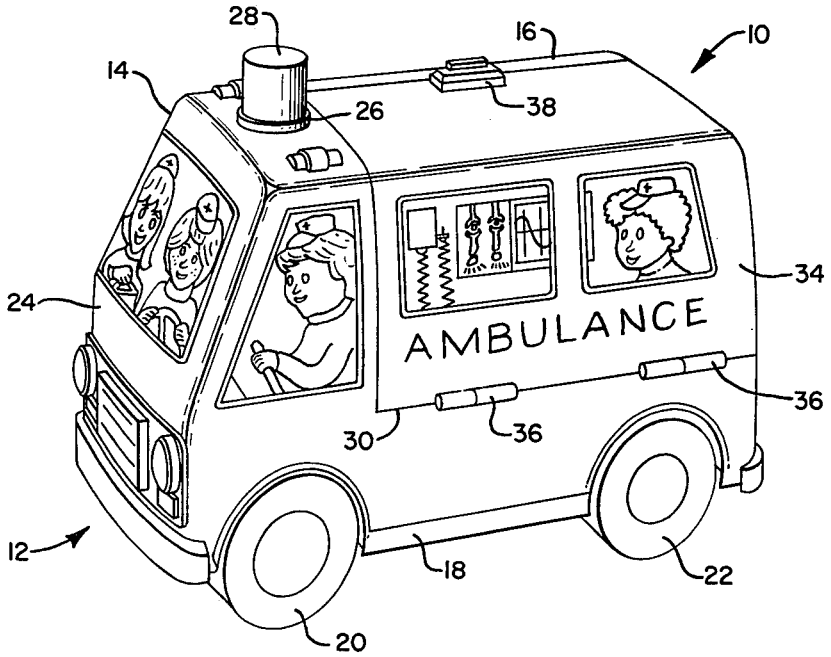
FIG. 1 is a perspective view of a toy ambulance unit of the present invention, illustrating the toy ambulance vehicle with the side door closed.
Figure 2:
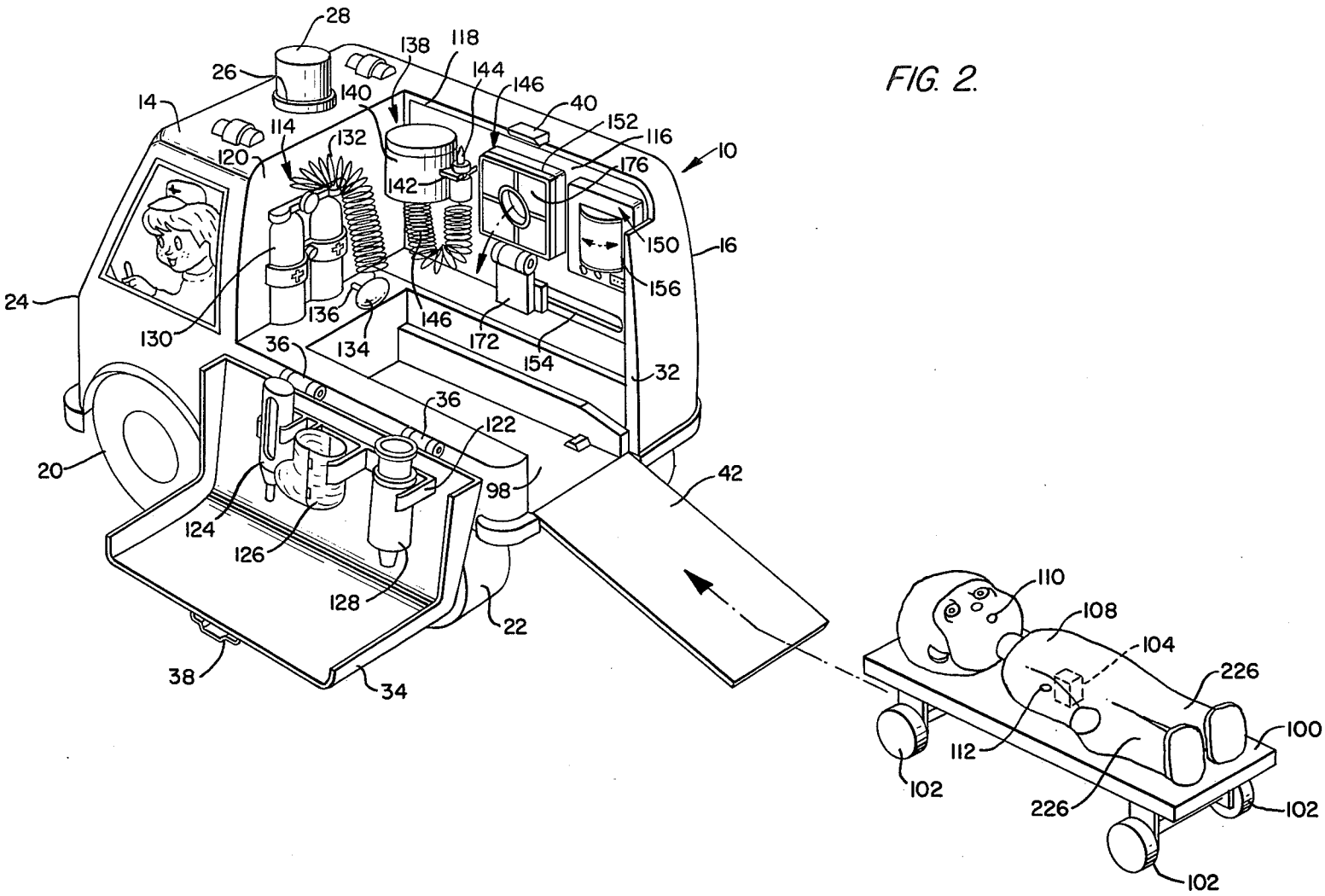
FIG. 2 is a perspective view of the toy ambulance unit with the side door and the rear door of the toy ambulance vehicle opened, illustrating generally the movement of the cover member of the toy x-ray machine, the rotation of the drum in the toy medical oscilloscope, and movement of the doll mounted upon the stretcher into the patient portion of the toy ambulance vehicle.

The toy ambulance unit 10 of the present invention is illustrated in FIGS. 1 and 2, and includes toy ambulance vehicle 12 having cab portion 14 and patient portion 16. Vehicle 12 is provided with chassis 18 on which front wheels 20 and rear wheels 22 are mounted for rotation. Body 24 of vehicle 12 is fixedly attached to chassis 18, and is provided with opening 26 through which siren button 28 protrudes, side opening 30 which allows access to the interior of patient portion 16, and rear opening 32 for placement and removal of the toy "patient." Side door 34 is pivotably attached to vehicle 12 by hinges 36, and is provided with latch mechanism 38 which is positioned to engage latch mechanism 40 provided at the top of the vehicle 12. Similarly, rear door 42 is pivotably provided at the rear of vehicle 12 to close patient portion 16 and to provide an access ramp for placement and removal of the toy "patient."

Figure 8:
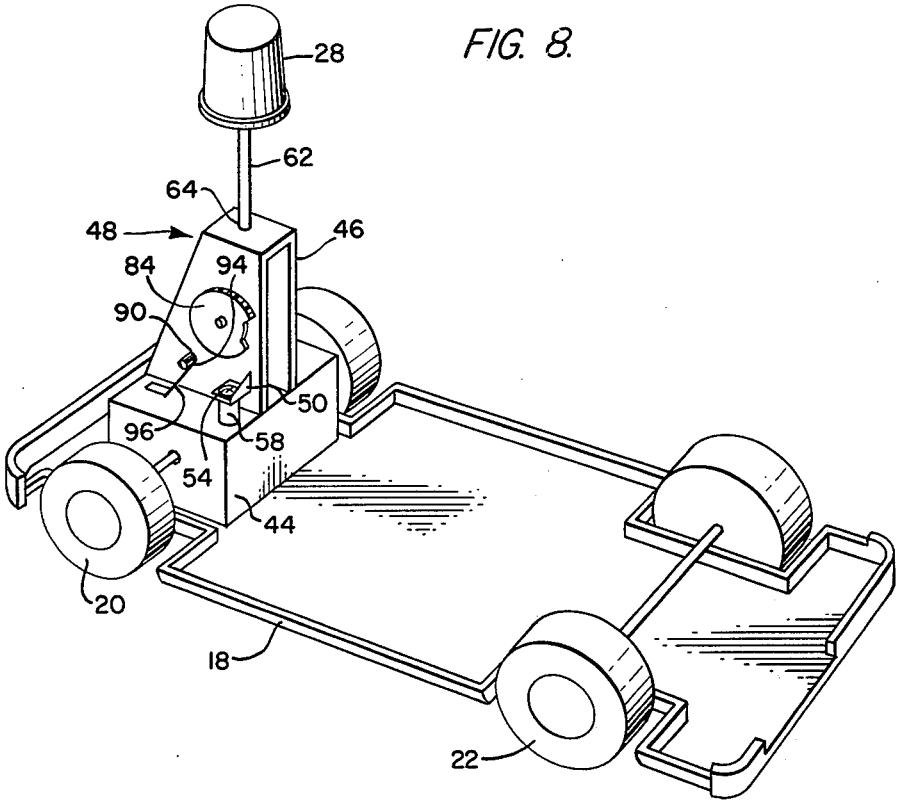
FIG. 8 is a perspective view of the vehicle chassis with the siren mechanism mounted thereon.
Figure 9:
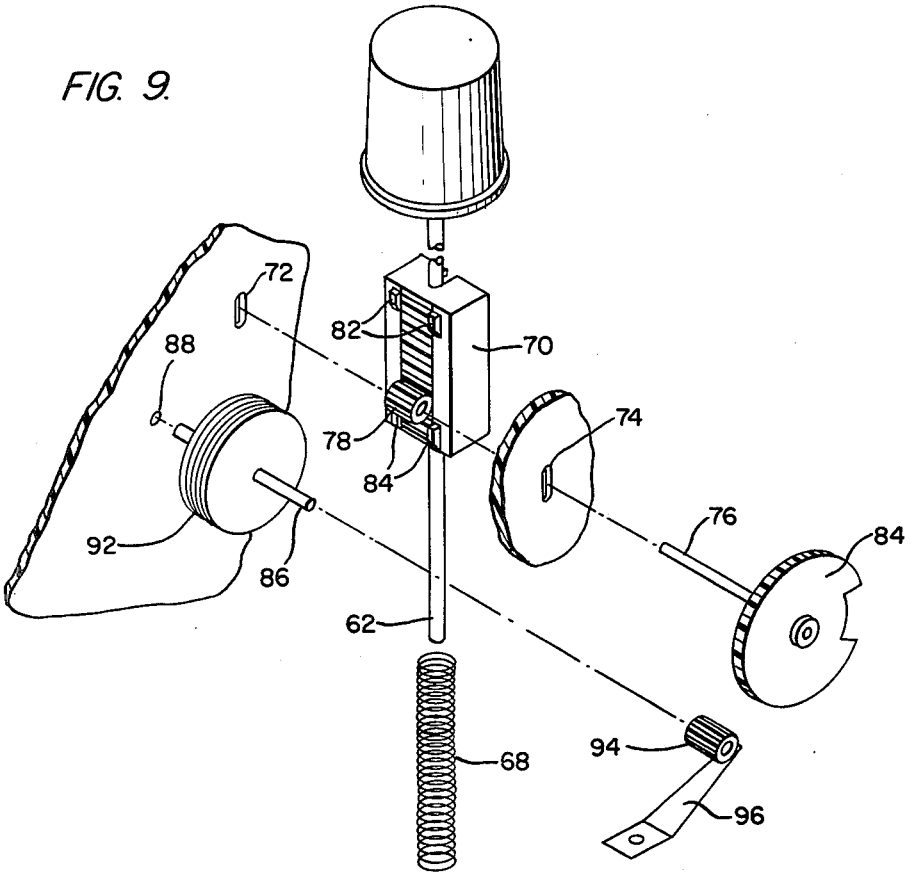
FIG. 9 is an exploded perspective view of a portion of the siren mechanism shown in FIG. 8.

Turning now to FIG. 8, chassis 18 is provided with pedestal 44 for supporting sub-chassis 46, which houses siren assembly 48. Sub-chassis 46 is provided with tab 50 and tab 52 (not shown) through which screws 54 and 56 (not shown) extend for mounting sub-chassis 46 to mounting post 58 and 60 (not shown) provided on pedestal 44. Reciprocating rod 62 is capped by siren button 28 and extends through hole 64 in sub-chassis 46 and hole 66 (not shown) in pedestal 44. As is seen in FIG. 9, spring 68 extends around rod 62 from pedestal 44 to element 70, which is fixably attached to rod 62. It will be apparent that depression of button 28 will cause element 70 to move downward along with reciprocating rod 62, which is guided by holes 64 and 66. When button 28 is released, the force of spring 68 will return rod 62 and element 70 to their original positions.

With continuing reference to FIGS. 8 and 9, sub-chassis 46 is provided with slots 72 and 74 through which shaft 76 extends. Gear 78 is fixedly attached to shaft 76 and is located within sub-chassis 46 where it is positioned to engage rack of teeth 80 which are molded into the plastic from which element 70 is made. It will be apparent that when button 28 is depressed and element 70 moves downward, shaft 76 will be moved to the bottom of slots 72 and 74 and rotated by the action of teeth 80 on gear 78. When button 28 is released, element 70 will be restored to its former position and will move shaft 76 to the tops of slots 72 and 74. Element 70 is provided with pegs 82 which impinge upon shaft 76 when button 28 is depressed so as to prevent rod 62 from moving too far. Pegs 84 are also provided on element 70 to hold shaft 76 at the tops of slots 72 and 74 when button 28 is in its at-rest position. Gear 84 is fixedly attached to shaft 76 and is located outside of sub-chassis 46, where it rotates along with shaft 76 and is positioned depending upon whether shaft 76 is at the top or bottom of slots 72 and 74. Shaft 86 is mounted for rotation within holes 88 and 90 provided in sub-chassis 46. Mass 92 is fixedly mounted on shaft 86 and is positioned within sub-chassis 46, and gear 94 is fixedly mounted to shaft 86 but positioned outside of sub-chassis 46. It will be apparent that when button 28 is depressed, gear 84 will be rotated and moved downward where it will engage gear 94 and rotate mass 92, but upon release of button 28 gear 84 will be disengaged from gear 94, thus leaving gear 94 free to continue rotating by virtue of the momentum of mass 92. Metal buzzer member 96 is fixedly attached to pedestal 44 and extends upward to engage gear 94. When gear 94 rotates, member 96 produces a siren-like buzzing sound whose pitch varies depending upon the angular velocity of gear 94. In short, a child playing with the toy ambulance unit 10 of the present invention can produce siren sounds by repeated depression of button 28, which can be colored red in simulation of the emergency light of a real ambulance.

Returning now to FIG. 2, patient portion 16 of vehicle 12 is provided with depression 98 for accommodating stretcher 100, which is provided with wheels 102 and square peg 104 positioned to engage a square opening 106 (not shown) on the back of patient doll 108 to keep the latter firmly attached to the stretcher 100 while treatment is being administered. Patient doll 108 is provided with mouth opening 110 and arm opening 112 for receiving treatment and diagnosis from the toy medical devices which are part of toy ambulance unit 10.

With continuing reference to FIG. 2, the interior of patient portion 16 of vehicle 12 is provided with oxygen apparatus 114 and medical panel 116, which is accessible through opening 118 in the interior walls 120 provided within the patient portion 16 of vehicle 12. Moreover, the interior of side door 34 is provided with flexible plastic rack 122 for holding toy thermometer 124, toy foot cast 126, and toy hypodermic 128. Oxygen apparatus 114 includes oxygen cylinders 130 molded into the plastic forming walls 120, flexible plastic coil 132, and toy oxygen mask 134 provided with plug 136 for engaging mouth opening 110 positioned at the end of coil 132. Toy blood transfusion apparatus 138, which is removably mounted to medical panel 116, consists of covered reservoir 140 having mounting flanges 142 for accommodating toy needle 144, and flexible plastic coil 146 extending from the bottom of reservoir 140 to needle 144. Toy needle 144 can be inserted into arm opening 112 to give patient doll 108 a "transfusion." Toy hypodermic 128 can be used to give a "shot" in a similar manner.

With continuing reference to FIG. 2, the toy ambulance unit 10 of the present invention is also provided with toy x-ray unit 148 and toy medical oscilloscope 150. Accordingly, opening 152, slot 154, and opening 156 are provided in medical panel 116. Turning now to FIGS. 6 and 7, back panel 158 is mounted within vehicle 12 by four screws (not shown) a short distance behind medical panel 116. Square member 159, which bears a stylized representation of a portion of an x-ray on its face, is molded into the plastic which forms panel 158 and is directly behind opening 152 in panel 116. Sliding element 160, which is mounted for reciprocating movement between panels 116 and 158 by flange 162 (not shown) provided on panel 158 and flange 164 (now shown) provided on the back of panel 116, is provided with movable panel 166 and with projecting finger 168 having rack of teeth 170 at the end thereof. Mounting member 172 extends through slot 154 in panel 116 to be fixedly attached to sliding member 160 by means of screw 174 (not shown). Plastic cover member 176, having one surface molded to resemble the bellows of a camera, is provided with tabs 178 through which shaft 180 extends to pivotally mount member 176 to lug 182 provided on mounting member 172. It is apparent that a child playing with ambulance unit 10 can rotate cover member 176 away from opening 152 in medical panel 116 and view the stylized x-ray representation on member 159. Alternately, the child can move cover member 176 to the left (as shown in FIG. 6) to slide member 160 to a new position where a different stylized x-ray representation is visible on movable panel 166.

With continuing reference to FIGS. 6 and 7, shaft 184 is journaled for rotation behind opening 156 in panel 116. Toy oscilloscope drum 186 and gear 188 are fixedly attached to shaft 184. Paper 190 having wavy line 192 is wrapped around cylinder 186 so as to resemble the trace of an oscilloscope. It will be apparent that when cover member 176 is reciprocated, to change the stylized x-ray representation visible through opening 152, gear 188 will engage rack of teeth 170 on projecting finger 168 to rotate drum 186, thereby changing that portion of paper 190 visible through opening 156. The visible effect will resemble an oscilloscope trace which stabilizes to a set position when drum 186 stops rotating.

Figure 5:
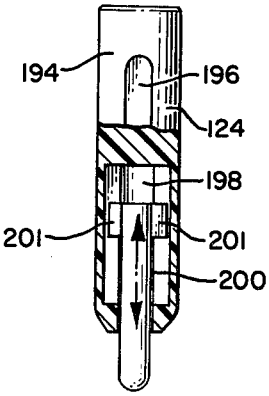
FIG. 5 is a front view partially in section of the toy thermometer, illustrating generally the motion of the reciprocating member.

Turning now to FIG. 5, toy thermometer 124 is composed of plastic thermometer body 194 having shallow slot 196 and deep slot 198 in which reciprocating member 200 is snugly but movably fitted. Reciprocating member 200 is provided with tabs 201 to prevent its removal from thermometer body 194. During use, a child can shake thermometer 124 to coax reciprocating member 200 out of thermometer body 194 before applying member 200 to mouth opening 110 of patient doll 108. Since member 200 has larger diameter than mouth opening 110, this action will push member 200 up slot 198 to make it appear that patient doll 108 has a fever.

Figure 3:
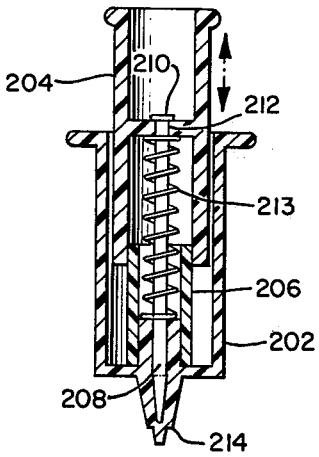
FIG. 3 is a side sectional view of the toy hypodermic mounted on the side door of the toy ambulance vehicle, illustrating generally the reciprocating motion of the plunger.

Referring next to FIG. 3, hypodermic 128 is composed of translucent hypodermic body 202, colored plastic plunger member 204 movably mounted within body 202, and central colored cylinder 206, which is mounted within body 202 and which has a smaller diameter than plunger member 204. Central rod 208 having button 210 at one end is disposed along the axis of hypodermic body 202 and through hole 212 in plunger member 204. Spring 213 is coiled around rod 208 to bias plunger member 204 in its retracted position. Body 202 is provided with toy needle 214 for engagement with arm opening 112 as described above. It will be apparent that a child can remove toy hypodermic 128 from rack 122 and apply needle 214 to arm opening 112 before depressing colored plunger member 204. When the latter is depressed, that portion of colored cylinder 206 (which may be colored red) visible through translucent hypodermic body 202 changes, as though a colored liquid contained within thermometer 124 were being injected into patient doll 108. When plunger member 204 is retracted it will appear that a fluid sample is being taken for use in diagnostic tests within ambulance unit 10.

Figure 4:
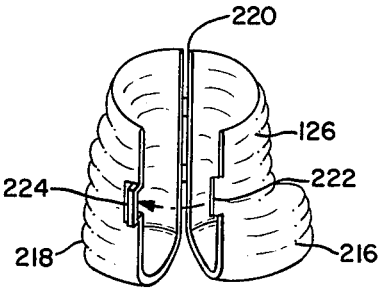
FIG. 4 is a perspective view of the toy foot cast illustrating generally the closure thereof.

Turning next to FIG. 4, toy foot cast 126 is molded from a single piece of flexible plastic having front portion 216 and heel portion 218 joined by a center strip of plastic 220 which acts as a hinge. Latch member 222 provided on front portion 216 is positioned to engage latch member 224 provided on heel portion 218 to lock cast 126 closed. It will be apparent that the child can diagnose a broken leg and apply a cast by wrapping toy foot cast 126 around a leg 226 of patient doll 108 and locking is shut.

The overall operation of toy ambulance unit 10 of the present invention can now be described. With stretcher 100 within vehicle 12 and doors 34 and 42 closed, the child can roll vehicle 12 to the supposedly injured patient doll 108, periodically depressing button 28 to sound the siren. Doll 108 can then be positioned on stretcher 100 and rolled into vehicle 12 for treatment. Using the various toy diagnostic and medical devices provided by the present invention, the child can administer oxygen, give transfusions, take x-rays, observe oscilloscope traces of vital functions, apply a cast, give shots, and take the temperature of doll 108. The wide range of toy medical devices available increases the child's enjoyment. Moreover, these devices complement each other so that a variety of imagined emergency medical problems can be met. Moreover, the changing images presented by toy x-ray unit 148 and toy medical oscilloscope 150 give the appearance of sophisticated medical technology of a type usually available only in a hospital environment.

I claim:

1. A toy ambulance unit for use with a doll, comprising:

a toy ambulance vehicle having a a patient portion, a side door giving access to said patient portion, and a rear door giving access to said patient portion;

a medical panel mounted within said toy ambulance vehicle, said medical panel being accessible to said patient portion and providing a first plurality of toy medical devices, including at least a toy x-ray unit and a toy medical oscilloscope, said toy medical oscilloscope comprising a rotatable drum and said toy x-ray unit comprising means for displaying first and second representations of x-rays; and means for mounting a second plurality of toy medical devices on said side door so that said toy medical devices are enclosed within said patient portion when said side door is closed.

2. The toy ambulance unit of claim 1, further comprising a button, and means mounting said button to said toy ambulance vehicle for producing a siren-like sound when said button is depressed.

3. The toy ambulance unit of claim 1, further comprising means for rotating said drum when the x-ray representation displayed by said toy x-ray unit is changed.

4. The toy ambulance unit of claim 3, further comprising:

a back panel mounted behind said medical panel, said first representation of an x-ray being positioned on said back panel;

a sliding member mounted for movement between said medical panel and said back panel, said sliding member being provided with a movable panel bearing said second representation of an x-ray and a projecting finger having a rack of teeth;

a button;

means mounting said button to said toy ambulance vehicle for producing a siren-like sound when said button is depressed; and wherein said means for rotating said drum when said x-ray representation displayed by said toy x-ray unit is changed comprises a gear operationally connected to said drum and positioned for engagement with said rack of teeth.

5. The toy ambulance unit of claim 4, wherein said means for producing a siren-like sound comprises:

a sub-chassis having two parallel sides and a slot in each of said sides, said sub-chassis being fixedly mounted within said toy ambulance vehicle;

a rod movably mounted on said sub-chassis between said sides, said button being mounted on said rod;

a shaft extending through said slots;

a first gear mounted between said parallel sides on said shaft;

a member fixedly mounted on said rod between said parallel sides, said member having a rack of teeth engaging said first gear;

a metal buzzer member mounted to said toy ambulance vehicle;

a second gear rotatably mounted on said sub-chassis and positioned to engage said metal buzzer member; and means for transmitting rotation between said shaft and said second gear when said button is depressed.

6. A toy ambulance unit for use with a doll, comprising:

a toy ambulance vehicle having a patient portion, a side door giving access to said patient portion, and a rear door giving access to said patient portion;

a medical panel mounted within said toy ambulance vehicle, said medical panel being accessible to said patient portion and providing a first plurality of toy medical devices, including at least a toy x-ray unit and a toy medical oscilloscope, said toy medical oscilloscope comprising a rotatable drum and said toy x-ray unit comprising means for displaying first and second representations of x-rays;

means for mounting a second plurality of toy medical devices on said side door so that said toy medical devices are enclosed within said patient portion when said side door is closed;

a back panel mounted behind said medical panel, said first representation of an x-ray being positioned on said back panel;

a sliding member mounted for movement between said medical panel and said back panel, said sliding member being provided with a movable panel bearing said second representation of an x-ray and a projecting finger having a rack of teeth;

a button;

means mounting said button to said toy ambulance vehicle for producing a siren-like sound when said button is depressed;

means for rotating said drum when the x-ray representation displayed by said toy x-ray unit is changed, wherein said means for rotating said drum when said x-ray representation displayed by said toy x-ray unit is changed comprises a gear operationally connected to said drum and positioned for engagement with said rack of teeth;

a doll provided with an arm opening; and a toy blood transfusion apparatus affixed to said medical panel, said toy blood transfusion apparatus comprising a toy reservoir, a toy needle configured for insertion into said arm opening of said doll, and a flexible plastic coil extending from said toy reservoir to said toy needle.

7. The toy ambulance unit of claim 6, further comprising a toy hypodermic mounted on said means for mounting a second plurality of toy medical instruments on said side door, said toy hypodermic comprising a translucent hypodermic body having a toy needle configured for insertion into said arm opening of said doll, a central colored cylinder mounted within said translucent hypodermic body along the axis thereof, a colored plastic plunger member mounted for reciprocating movement between said translucent body and said colored cylinder, and spring means biasing said plunger member away from said central cyliner.

8. The toy ambulance unit of claim 7, wherein said doll also has a mouth opening, and further comprising a toy thermometer mounted on said means for mounting a second plurality of toy medical instruments on said side door, said toy thermometer comprising a plastic thermometer body having a deep slot therein, and a reciprocating member movably but snugly fitted within said slot.

9. The toy ambulance unit of claim 8, wherein said patient portion of said toy ambulance vehicle is provided with plastic interior walls, and further comprising a toy oxygen apparatus having at least one oxygen bottle molded into the plastic forming said interior walls, a toy oxygen mask having a plug therein for insertion into said mouth opening of said doll, and a flexible plastic coil connecting said at least one toy oxygen bottle and said toy oxygen mask.

10. The toy ambulance unit of claim 9, wherein said doll has at least one foot and further comprising a foot cast mounted on said means for mounting a second plurality of medical devices to said side door, said foot cast comprising a first portion having a latch member thereon, a heel portion having a latch member positioned to engage said latch member provided by said first portion, and a hinge joining said front portion and said heel portion.

11. A toy ambulance unit for use with a doll having a mouth opening, an arm opening, and at least one foot, comprising:

a toy ambulance vehicle having a patient portion, a side door giving access to said patient portion, a medical panel accessible to said patient portion, said medical panel having first and second openings, and a rear door giving access to said patient portion;

a toy x-ray unit mounted on said medical panel, said toy x-ray unit having means for displaying first and second representations of x-rays through said first opening;

a toy medical oscilloscope mounted on said medical panel, said toy medical oscilloscope comprising a rotatably mounted drum visible through said second opening;

means mounted on said medical panel and operationally connected to said toy x-ray unit for rotating said drum when the x-ray representation visible through said first opening in said medical panel changes;

a toy blood transfusion apparatus mounted to said medical panel, said toy blood transfusion apparatus comprising a reservoir, a toy needle adopted for insertion in said arm opening of said doll, and a flexible plastic coil connecting said reservoir and said needle;

a toy oxygen apparatus mounted within said toy ambulance vehicle, said toy oxygen apparatus comprising at least one toy oxygen bottle, a mask having a plug adopted for insertion into said mouth opening of said doll, and a flexible plastic coil connecting said at least to an oxygen bottle and said toy oxygen mask;

means for mounting a plurality of toy medical devices on said side door so that said medical devices are enclosed within said patient portion when said side door is closed;

a toy thermometer mounted on said means for mounting a plurality of toy medical instruments on said side door;

a toy foot cast mounted on said means for mounting a plurality of toy medical devices on said side door; and a toy thermometer mounted on said means for mounting a plurality of toy medical devices on said side door.

* * * * *